US006298012B1

(12) United States Patent
Benjamin

(10) Patent No.: US 6,298,012 B1
(45) Date of Patent: Oct. 2, 2001

(54) DOUBLY RESONANT PUSH-PULL FLEXTENSIONAL

(75) Inventor: Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/413,057

(22) Filed: Oct. 4, 1999

(51) Int. Cl.[7] ..... H04R 17/00
(52) U.S. Cl. ..... 367/174; 367/141; 367/163
(58) Field of Search ..... 367/173, 176, 367/153, 159, 163, 165, 141, 160, 161, 174; 310/337, 321

(56) References Cited

U.S. PATENT DOCUMENTS 4,384,351 * 5/1983 Pagliarini, Jr. et al. ..... 367/175
4,764,907 * 8/1988 Dahlstrom et al. ..... 367/163
4,972,390 * 11/1990 Pagliarini, Jr. ..... 367/158
5,515,343 * 5/1996 Boucher et al. ..... 367/158
5,757,728 * 5/1998 Tenghamn et al. ..... 367/163
5,926,439 * 7/1999 Piquette ..... 367/161

* cited by examiner

*Primary Examiner*—Ian J. Lobo
(74) *Attorney, Agent, or Firm*—Michael J. McGowan; Prithvi C. Lall; Michael F. Oglo

(57) ABSTRACT

The present invention relates to a flextensional transducer device comprising a multi-resonant shell and push-pull driving system for driving the shell so as to provide at least two tunable resonant modes, thereby increasing the operational bandwidth of the device. The push-pull driving system is formed by four rings of active drive material grouped to operate as two opposing push-pull pairs. The shell has a dog-bone configuration with two arcuately shaped interior web portions joined to the pairs of rings, end sections joined to the interior web portions, and a central concave section which functions as the primary radiating surface. Upon application of a desired current to the push-pull ring pairs, the interior web portions are caused to vibrate, which vibrations are transmitted to the end sections and the central concave section. By raising or lowering the bending stiffness of the interior web portions, the end sections, and the central concave section, one can selectively tune the modal resonance of the shell.

7 Claims, 1 Drawing Sheet

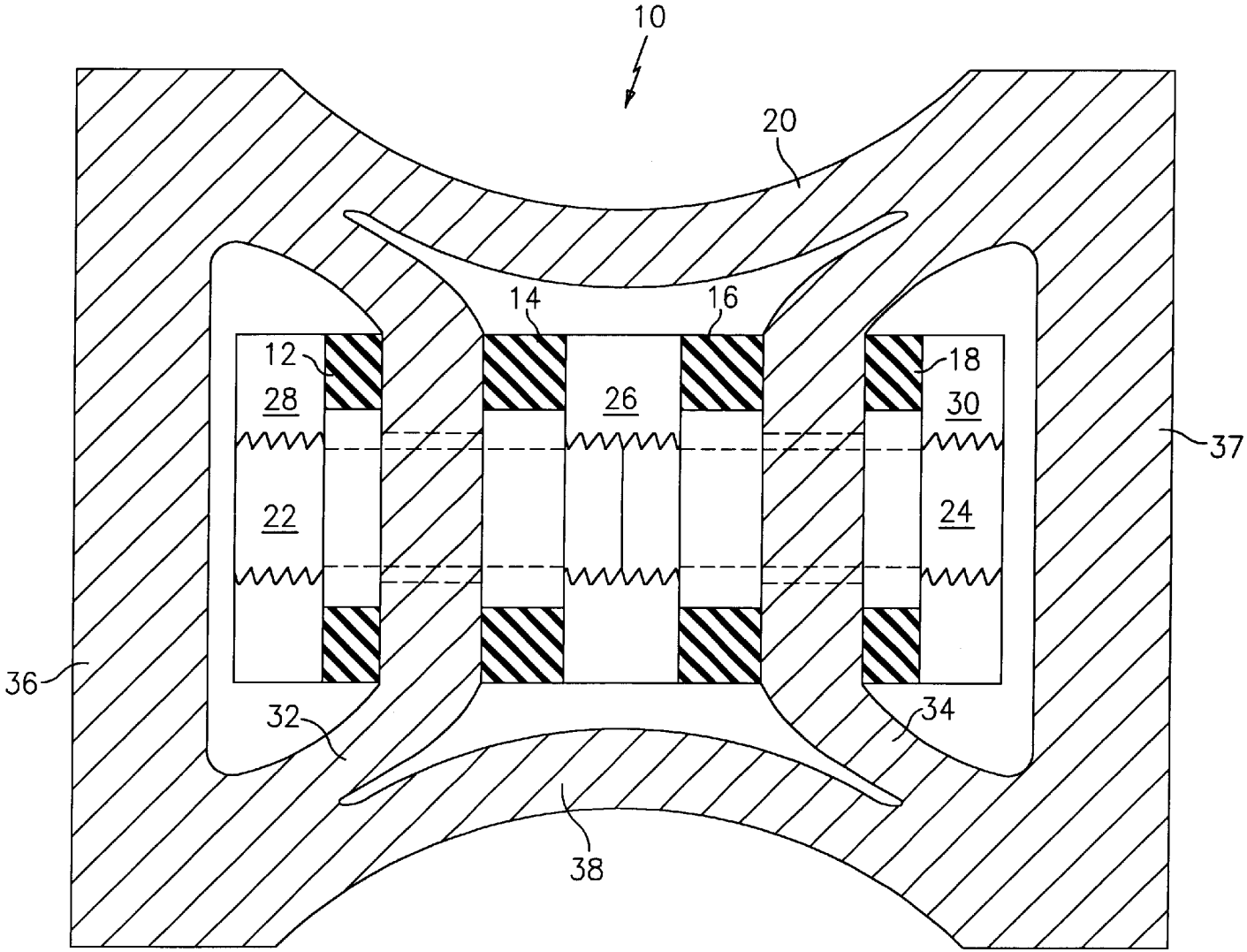
10
12
14
16
18
20
22
24
26
28
30
32
34
36
37
38

DOUBLY RESONANT PUSH-PULL FLEXTENSIONAL

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The present invention relates to a doubly resonant push-pull class IV (dog bone) flextensional transducer having an improved operational bandwidth.

(2) Prior Art

Flextensional transducer devices are known in the prior art and have been used in a wide variety of applications. For example, U.S. Pat. No. 3,583,677 to Phillips describes an electro-mechanical transducer for secondary oil recovery. The transducer provides a dipole-type radiation field which extends along a single axis perpendicular to the axis of an oil well. This allows a surrounding casing to vibrate in a displacement mode rather than in a circumferential expansion mode to enable energy coupling to a surrounding oil-producing formation. The transducer includes two resonant beams forced to vibrate at an audio or sonic frequency by piezoelectric element stacks driven by an external electrical power source and transferring energy through additive shear waves to an external body. The transducer described in Phillips is a single frequency device operating in a shear bending mode.

U.S. Pat. No. 4,462,093 to Upton illustrates a transducer support system that couples the weight of the active portion of a transducer to the transducer's flanges without coupling the dynamic motion of the active portion of the transducer to the transducer's flanges. This support system is used in a flextensional transducer to produce a transducer with increased acoustic output and lower frequency.

U.S. Pat. No. 4,764,907 to Dahlstrom et al. illustrates an underwater transducer which includes a centrally located beam, a plurality of stacks of piezoelectric transducer elements extending from each side, and a rigid end beam at the opposite end of each stack. A plurality of bolts extending from one end beam to the other, on opposite sides of the stacks, are tightened to apply a desired amount of prestress on the ceramic stacks. Arcuate radiating elements are welded to opposite sides of each end beam, end cap members are fastened to the centrally located beam at each end of the transducer, and a jacket of elastomeric material is bonded to the edges of the end cap members to prevent ingress of fluid into the piezoelectric elements. Energizing of the piezoelectric elements causes expansion and contraction of the stacks, pushing the end beams in and out and causing bowing of the radiating elements to project sonar energy.

U.S. Pat. No. 5,291,461 to Boeglin et al. relates to an elastomer support for a sonar transducer which includes a ceramic stack electromechanical driver, a pair of rigid support members, and a pair of elastomer layers disposed between the ceramic stack electromechanical driver and the support members. The elastomer support provides effective mechanical stress reduction in the ceramic stack driver. The Boeglin et al. patent also describes a technique for removing excess heat from the ceramic stack components under high drive conditions.

U.S. Pat. No. 5,566,132 to Janus et al. relates to an acoustic transducer to which mechanical pre-stress is applied to the piezoceramic by spreading two plates symmetrically from the center with a bolt and nut arrangement. The acoustic transducer includes a housing and first and second stacks of transduction plates disposed within the housing. The first and second stacks are adapted to be held in compression between the housing opposed wall portions. A threaded stud extends from the first stack to the second stack. A nut is threadly engaged with the stud and adjacent one of the stacks. Movement of the nut on the stud operates to move the stacks toward the housing walls to compress the stacks, and operates to relax compressive force on the stacks to enable withdrawal of one of the stacks and replacement thereof.

Recently, polycrystalline and single crystal electrostrictive drive materials have been receiving considerable interest in research programs due to their significantly higher output power density potential. However, direct substitution of these new materials for those currently used is not possible without redesigning the transducer element's mechanical and/or electrical configuration. This is due to both elastic moduli differences and the fact that the new materials, unlike their PET counterparts, come unpolarized and require a D.C. bias for linear operation. One method of eliminating the need for D.C. bias for linear operation is operating the drive material in a push-pull mode whereby half-stack pairs are driven unidirectionally with alternating and opposing polarity.

SUMMARY OF THE INVENTION

Accordingly, it is an object of the present invention to provide a flextensional transducer device which produces multiple shell resonances for increased operational bandwidth.

It is a further object of the present invention to provide a flextensional transducer device as above which is lightweight and compact.

It is yet another object of the present invention to provide a flextensional transducer device as above which has utility in underwater applications.

The foregoing objects are attained by the flextensional transducer device of the present invention.

In accordance with the present invention, a flextensional transducer device comprises a multi-resonant shell and push-pull means for driving the shell so as to provide at least two tunable resonant modes, thereby increasing the operational bandwidth of the device. The push-pull drive means is formed by four rings of active drive material grouped to operate as two opposing push-pull pairs. The shell has a dog-bone configuration with two arcuately shaped interior web portions joined to the pairs of rings, end sections joined to the interior web portions, and a central concave section which functions as the primary radiating surface. Upon application of a desired current to the push-pull pairs, the interior web portions are caused to vibrate. These vibrations are transmitted to the end sections and the central concave section. By raising or lowering the bending stiffness of the interior web portions, the end sections, and the central concave section, one can selectively tune the modal resonance of the shell.

Other details of the flextensional transducer device of the present invention, as well as other objects and advantages attendant thereto, are set forth in the following detailed description and the accompanying drawing wherein like reference numerals depict like elements.

BRIEF DESCRIPTION OF THE DRAWING(S)

The single FIGURE is a sectional view of a flextensional transducer device in accordance with a preferred embodiment of the present invention.

DESCRIPTION OF THE PREFERRED EMBODIMENT(S)

The FIGURE illustrates an improved flextensional transducer device 10 in accordance with the present invention. The transducer device 10 has a multi-resonant housing or shell 20 which flexes to propagate acoustic waves in a surrounding medium, such as seawater, and which has at least two tunable resonant modes. The shell 20 may be formed from any suitable material known in the art such as steel, glass fibers in an epoxy matrix, or an elastomeric material.

As can be seen from the FIGURE, the shell 20 has a dogbone shape. The shell 20 includes end sections 36 and 37 and a concave central section 38 joining the two end sections 36 and 37. The shell 20 further includes a pair of interior arcuately shaped web portions 32 and 34. A center web 26 is positioned within the interior of the shell 20 and may be joined to the shell 20 in any desired manner.

A plurality of rings 12, 14, 16, and 18 formed from an active drive material are positioned symmetrically about the midplane of the shell 20. The active drive material from which the rings 12, 14, 16, and 18 are formed may comprise any suitable biased or unbiased, electrostrictive, magnetostrictive, or piezoelectric material known in the art. Two stiff tie rods 22 and 24, formed from a metallic material, threadly engage the center web 26. The tie rods 22 and 24 also respectively threadly engage end plates 28 and 30. The tie rods 22 and 24 thereby pin the active material in the rings 12, 14, 16, and 18 against the shell 20 and provide a mechanical prestress on the active material required for high drive operation.

The rings 12, 14, 16, and 18 are the drivers for the transducer 10 and are grouped as two opposing push-pull pairs 12 and 14, 16 and 18. The pairs 12 and 14 and 16 and 18 are joined to a source (not shown) of electrical current for driving the pairs 12 and 14 and 16 and 18 unidirectionally with alternating and opposing polarity. Any suitable electrical current source known in the art for operating the pairs in a push-pull manner may be used. Still further, the rings 12, 14, 16, and 18 may be electrically connected to the source in any suitable manner known in the art.

Upon application of the appropriately phased electrical signals to the pairs or stacks of rings 12 and 14 and 16 and 18, shell sections 32 and 34 are caused to vibrate. This in turn causes shell sections 36, 37 and 38 to vibrate. In the device 10 of the present invention, the section 38 is the primary radiating surface. A mechanical strain amplification results for shell section 38 due to the shell geometry.

One of the important advantages to the flextensional transducer device of the present invention is that, unlike a longitudinal vibrator, the dimensions of the shell govern the device's resonance frequencies and not the length of the stacks. This implies the use of less drive material for a given frequency range of operation.

Lightweight and compactness, which result directly from the flextensional shell/stack arrangement, is a further advantage of the transducer of the present invention. The reduction in the relative amount of drive material results in a lower unit cost for a given transducer size. Another advantage of the transducer of the present invention is the increased operational bandwidth obtained by the multi-resonant shell 20. Raising or lowering the bending stiffness of the shell sections 32, 34, 36, 37, and 38 allows one to selectively tune the modal resonance of the shell 20.

It is apparent that there has been provided in accordance with the present invention a doubly resonant push-pull flextensional transducer device which fully satisfies the means, objects, and advantages set forth hereinbefore. While the present invention has been described in the context of specific embodiments thereof, modifications, variations, and alternatives will become apparent to those skilled in the art having read the foregoing description. Therefore, it is intended to embrace such modifications, variations and alternatives as fall within the broad scope of the appended claims.

What is claimed is:

1. A flextensional transducer device which comprises:

a multi-resonant shell having a dog-bone shape;

push-pull means for driving said shell so as to provide at least two tunable resonant modes, thereby increasing the operational bandwidth of the device;

said push-pull driving means comprising four rings of drive material positioned symmetrically about the midplane of said shell, said rings being grouped to operate as two opposing push-pull pairs; and a center web joined to said shell and each of said rings being joined to said center web by a respective tie rod.

2. A flextensional transducer device according to claim 1 further comprising an end plate threadly engaging each respective tie rod, and each said end plate pinning a respective pair of rings against said shell.

3. A flextensional transducer device according to claim 2 wherein said shell has two arcuately shaped interior web portions and wherein one of said web portions is positioned between a respective pair of rings, whereby said arcuately shaped interior web portions are caused to vibrate when said ring pairs are operated in a push-pull mode.

4. A flextensional transducer device according to claim 3 wherein said shell has two end sections and a concave central section intermediate of and joined to said end sections and wherein vibration of said interior web portions causes vibration of said end sections and said concave central section.

5. A flextensional transducer device according to claim 4 wherein said concave central section comprises a primary radiating surface.

6. A flextensional transducer device which comprises:

a multi-resonant shell having a first end section, a second end section and a central concave section which functions as the primary radiating surface;

first and second interior web portions joined to said first and second end sections; and push-pull drives connected to said first and second interior web portions for driving said shell so as to provide at least two tunable resonant modes.

7. A flextensional transducer device according to claim 6, wherein said push-pull drives comprises a first pair of rings joined to said first interior web portion and a second pair of rings joined to said second interior web portion.

* * * * *